United States Patent [19]

Bingham

[11] 4,312,749

[45] Jan. 26, 1982

[54] TRAILER MOUNTED, PORTABLE COAL WASHING AND SEPARATING APPARATUS

[76] Inventor: Harold L. Bingham, Rte. 3, Richmond, Ky. 40475

[21] Appl. No.: 258,165

[22] Filed: Apr. 27, 1981

[51] Int. Cl.[3] ..... B03B 5/56

[52] U.S. Cl. ..... 209/44; 209/298; 209/452

[58] Field of Search ..... 209/17, 173, 172.5, 209/44, 452, 155, 451, 482, 288, 293, 294, 297, 298

[56] References Cited

U.S. PATENT DOCUMENTS

| | | | |
|---|---|---|---|
| Re. 16,674 | 7/1927 | Chance | 209/172.5 |
| 299,337 | 5/1884 | Brotherhood | 209/452 X |
| 2,286,132 | 6/1942 | Walle | 209/451 X |
| 2,331,135 | 5/1943 | Ovestrud | 209/17 X |
| 2,599,402 | 6/1952 | Lindsey | 209/437 X |
| 4,203,831 | 5/1980 | Parnaby | 209/452 X |

FOREIGN PATENT DOCUMENTS

| | | | |
|---|---|---|---|
| 201876 | 4/1939 | Switzerland | 209/44 |

*Primary Examiner*—Ralph J. Hill

*Attorney, Agent, or Firm*—Sughrue, Mion, Zinn, Macpeak & Seas

[57] ABSTRACT

A trailer chassis supports an apparatus for separating a lighter specific gravity material such as coal from higher specific gravity waste material. An open ended, elongated cylindrical drum is mounted for rotation about its axis inclined slightly from the horizontal, the drum bearing helical strips along the inner wall to drive the waste towards the inlet end. Water borne coal and waste enters the upper end of the drum. One of a plurality of annular baffle plates at the rear of the drum maintain a water level permitting floating of the lighter weight coal off of the heavier waste, where it spills over the baffles. A wire screen covers openings within the drum wall to the rear, between longitudinally spaced baffle plates to permit dewatering and removal of fine waste from the coal which exits the open rear end after passing from chamber to chamber, partially defined by the annular baffle plates. An auger underlying the chassis drives the water and fine waste forwardly. Water and fine waste is removed from a frontal screen area of the rotating drum, upstream of the discharge point for a chute bearing the water and unwashed coal leading into the drum.

7 Claims, 4 Drawing Figures

TRAILER MOUNTED, PORTABLE COAL WASHING AND SEPARATING APPARATUS

BACKGROUND OF THE INVENTION

Apparatus have evolved over the years for washing coal and concentrating ores in which materials of different specific gravities are separated by immersion in a fluid mass such as water of specific gravity high enough to effect the floatation of that portion of the materials of lower specific gravity. Characteristically, such type of apparatus have comprised either a rotating drum having inclined sidewalls and mounted for rotation about a horizontal axis or a cylindrical drum whose axis is inclined slightly with respect to the horizontal and wherein internally of the drum and on the inner surface of the drum, helical strips of limited height are provided and the direction of rotation of the drum is controlled such that upon rotation of the drum, the heavier mass materials seek by gravity the surface of the drum beneath the liquid mass causing floatation are driven towards a given open end of the drum itself. One such type of apparatus is illustrated in U.S. Pat. No. Re. 16,674 to Thomas M. Chance, reissued July 12, 1927, and entitled "Method and Apparatus for Separating Materials of Different Specific Gravities."

The apparatus of U.S. Pat. No. Re. 16,674, in one embodiment takes the form of a drum which rotates about a horizontal axis and which includes diverging portions from the end towards the center such that the drum is formed by two frustoconical portions joined at the center. The drum bears on the inner surface of both portions helical conveying elements which tend to drive, due to the rotation of the drum, the higher specific gravity material while the clean coal floats to the top of the surface of the water confined within the drum. Water and fine waste exits the drum at both the inlet and outlet ends through wire mesh covering openings within the drum wall and the water is separated from the fine waste and recirculated.

In a further embodiment of this invention, Chance discloses a cylindrical drum which is mounted for rotation about its axis and inclined to the horizontal, and wherein the drum bears internally thin spiral strips functioning as conveying elements tending to convey the higher specific gravity particles towards the open, upper end of the drum. The fines and water pass through an open mesh screen gate covering an opening within the drum wall, while the larger particles are discharged at that end of the apparatus. At the other end, the lighter particles of lower specific gravity float off through a screen cylinder onto a trough for removal from the rotating drum.

While such apparatus employed by Chance in the two different forms of FIGS. III and IV, permit satisfactory operation, the apparatus is complicated, maintained at a fixed geographical location, requires complicated water spray delivery pipes for agitating the accumulated water within the bottom of the drum, and fails to provide the desired separation of the high specific gravity material from the low specific gravity material and in terms of unwashed coal as the entry material, it fails to provide not only the desired degree of separating but also the washing of the coal to commercial satisfaction.

It is, therefore, a primary object of the present invention to provide a compact apparatus for improved separation of coal from waste material of higher specific gravity controlled washing of the coal during such process and wherein the apparatus is vehicle mounted to permit portability from site to site.

SUMMARY OF THE INVENTION

The present invention is directed to an improved vehicle trailer mounted apparatus for separating a lower specific gravity material such as coal from a material of higher specific gravity while washing the coal. The apparatus comprises an open ended, elongated, cylindrical drum mounted for rotation about its axis and being inclined slightly from the horizontal with its rear end lower than its front end. Helical strips are mounted to the inner wall of the drum. A chute opens into the upper end of the drum for supplying to the drum a mixture of lighter and heavier specific gravity materials, such as unwashed coal, and means are provided for supplying water to the interior of the drum and for maintaining a layer of water within the bottom of the drum such that the lighter specific gravity materials float with the water towards the lower, rear end of the drum. Rotation of the drum functions to agitate the materials within the accumulated water and to drive the higher specific gravity materials towards the upper open end of the drum.

The improvement resides in the provision of screened openings within the drum adjacent its lower end separated by a plurality of longitudinally spaced annular baffle walls bearing central openings. Angled diverter strips are carried by the drum along the inner wall overlying the screen portion and extend between the baffle walls, acting to lift the lighter specific gravity material over the longitudinally spaced baffle walls and through the baffle wall central openings to permit axial drum discharge of the washed and separated coal while freely permitting the water and waste fines to pass by gravity through the screened openings at that lower end of the drum.

Additionally, the upper end of the drum, upstream of the point where the chute enters the drum interior, is provided with openings bearing screening. The helical strips terminate at their upper ends, adjacent to the screened openings such that the higher specific gravity waste material in discharging through the open upper end of the drum and passing over the screening allows water and fine waste to be separated therefrom by gravity.

Preferably, the apparatus involves a waste trough which underlies the rotating drum which extends the full length of the rotating drum from one screened end to the other. The waste trough bears a rotating auger which is driven in rotation about its axis to drive water and fine waste from the rear of the apparatus towards the front of the apparatus as received from the front and rear screened portions of the drum.

At the rear of the drum, there are preferably at least three annular baffle plates longitudinally spaced within the drum, at right angles to the axis of the drum. The upstream baffle plate has the smallest circular opening within the center of the same, the downstream drum has the largest circular opening and the intermediate baffle plate has a circular central opening which is larger than that of the upstream baffle plate and smaller than that of the downstream baffle plate.

Generally L-shaped diverter plates are mounted to the interior of the drum, at circumferentially spaced positions about the cylindrical drum, overlie the screened openings and extend between and are fixed at their ends to the longitudinally spaced baffle plates. The L-shaped diverter plates are positioned such that their downstream ends in the direction towards the open, lower end of the drum extend above the height of the annular baffle plates to which the downstream end of the diverter plates are affixed, whereby the lower specific gravity material (coal) which falls into the compartments created by the longitudinally spaced baffle plates are guided by the diverter plates during rotation of the drum and are forced to ride up and over the downstream portions of the L-shaped diverter plates and to pass through the central openings within the annular baffle plates from compartment to compartment and finally through a central outlet opening within the downstream baffle plate at the lower end of the cylindrical drum.

Preferably, the drum is mounted for rotation on an angularly adjustable, inclined cradle borne by a horizontally extending trailer chassis. The trailer chassis may bear wheels both at its forward and rear ends, alternatively stanchions may be provided to the front end not bearing wheels for permitting vertical adjustable fixing of the trailer chassis at that end to insure chassis leveling. The cradle may be mounted for rotation about a fixed horizontal pivot axis at its forward end, and at the rear of the chassis, means are provided for adjustably fixing the position of the rear end of the cradle such as to define and maintain a desirable angle of inclination for the cradle and the cylindrical drum borne by the cradle with a slight inclination to the horiontal, upwardly toward the forward end of the drum.

DESCRIPTION OF THE PREFERRED EMBODIMENTS

Figure 1:
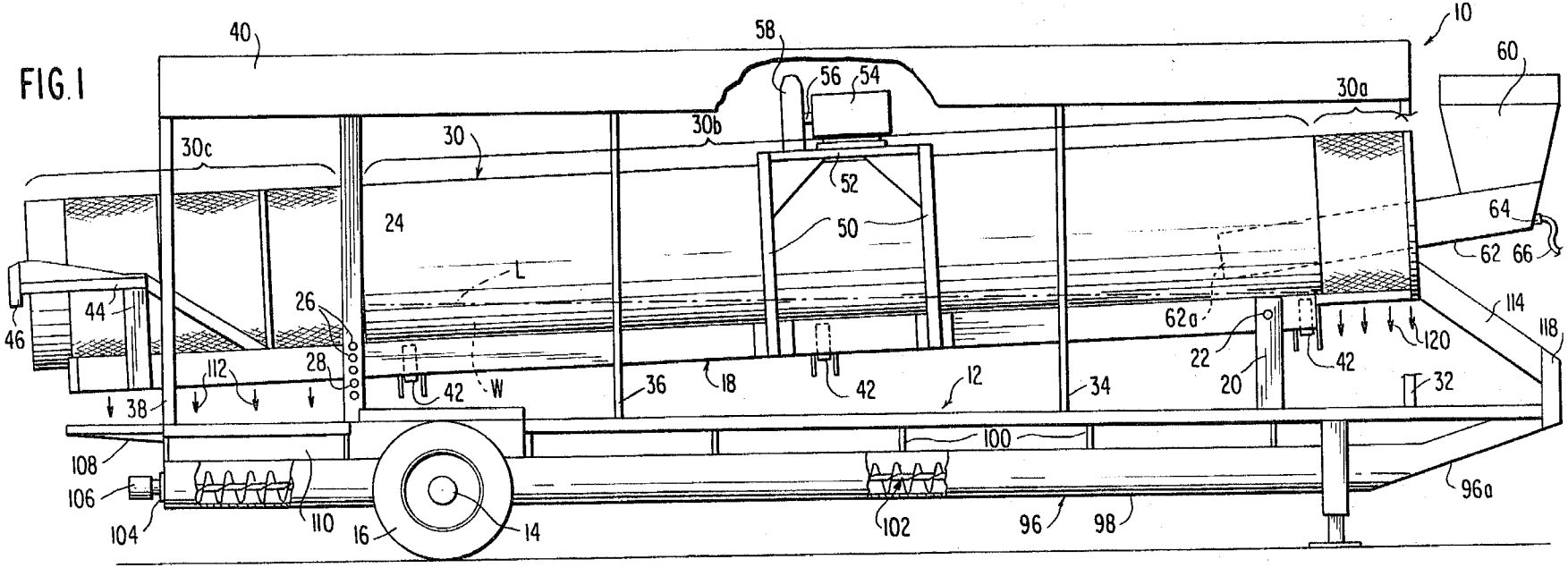
FIG. 1 is a side elevational view of the trailer mounted, portable coal washing and separating apparatus of the present invention and forming one embodiment thereof.

Referring to the drawings, the portable, trailer mounted coal washing and separating apparatus is indicated generally at 10 and forms a preferred embodiment of the invention. It is provided with a main vehicle frame or chassis 12 which extends generally the length of the apparatus and bears the apparatus components. The chassis in the illustrated embodiment takes the form of a trailer chassis which may be commercially purchased but modified to the extent necessary to provide support for coal washing and specific gravity separation apparatus. It should be kept in mind that while the apparatus 10 is principally employed in the washing of unwashed coal and the separation from the coal of waste material of higher specific gravity than that of the coal, it may be employed in the mining field in general, particularly for recovery of desired ore from waste material bearing such ore, i.e., ore beneficiation.

The chassis 12, while not illustrated as including a means at its forward end for coupling to a towing vehicle or the like, may be readily provided with such means. Near its rear, there is provided a vehicle axle as at 14 bearing paired wheels as at 16 in conventional trailer practice. The chassis 12 has mounted on the upper surface thereof a cradle indicated generally at 18, being supported at its foward end by a pair of vertical posts 20 whose upper ends bear a horizontal pin or rod 22, functioning as a forward fixed height, horizontal pivot axis for cradle 18. The cradle also is supported near its rear end by two vertical posts 24, on respective sides of cradle 18, bearing a plurality of holes 26 through which extend a further support rod 28 which may be moved from hole to hole, thereby changing the vertical support position of the rear end of cradle 18. It is a primary necessity to provide a desired inclination, not only of the cradle 18, but also the cylindrical drum indicated generally at 30 which is a major element of the coal washing and material separation apparatus.

As may be appreciated, additional vertical posts are provided to the chassis 12 as at 32, 34, 36 and 38 from the front of the chassis to the rear which function to mount an overlying cover or roof as at 40, the posts being provided on both sides of the chassis and functioning to form an open rectangular framework for supporting the roof 40.

As to cradle 18, the cradle 18 bears at longitudinally spaced positions a number of support rollers as at 42, on both sides, thereof, which are mounted for rotation about their axes and which contact the outer periphery of the cylindrical drum 30. Thus, the drum 30 is mounted for rotation about its axis. It is maintained in position by appropriate means including side framing 44 and cross piece 46 at the rear, which rotatably bears an axial rod 48 fixedly mounted to the rear end of drum 30, FIG. 3.

In order to rotatably drive the drum 30 about its axis and slightly inclined to the horizontal, as determined, for instance, by the position of rod 28 within opposed posts 24, the cradle 18 bears near its center, on opposite sides, longitudinally spaced vertical posts 50, between which extend a floor 52 overlying the drum 30. Fixedly mounted to the floor 52, is a variably speed drum motor 54 which may be electric, hydraulic or the like. The drive motor 54 includes a shaft 56, the shaft 56 bearing a rubber drive wheel as at 58 which rotates about its axis. Shaft 56 mounts the rubber drum drive wheel 58, and motor 54 is positioned such that the periphery of the rubber wheel 58 is in contact with the outer periphery of the cylindrical drum 30, so that frictionally, the rotation of the rubber drive wheel 58 acts to rotate drum 30 about its axis.

At the forward end of the trailer, there is fixedly mounted an upwardly open hopper 60 which merges at its bottom into a horizontally inclined coal supplying chute or trough 62 whose open lower end **62*a* is positioned internally of drum 30, and downstream of an upper screen portion or section 30*a* of that drum. The hopper 60 and the trough 62 are supported by means (not shown) and feed unwashed coal falling on the chute or trough 62, into drum 30. The coal moves by gravity and by a jet of water which flows down the chute or trough 62 from a water inlet nozzle or conductor tube 64 attached to a waste supply hose or the like as at 66. Nozzle 64 functions to supply water to the interior of the drum 30 and forces the unwashed coal down the inclined chute 62 and into the interior of the drum 30** for washing and agitated flotation separation therein.

Figure 3:
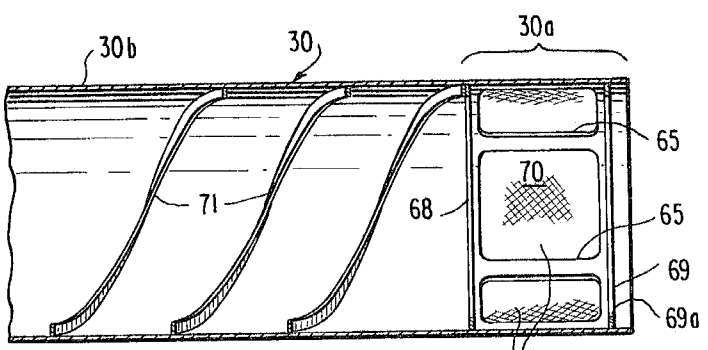
FIG. 3 is a longitudinal sectional view of the lower portion of the drum illustrated in FIG. 1.
Figure 2:
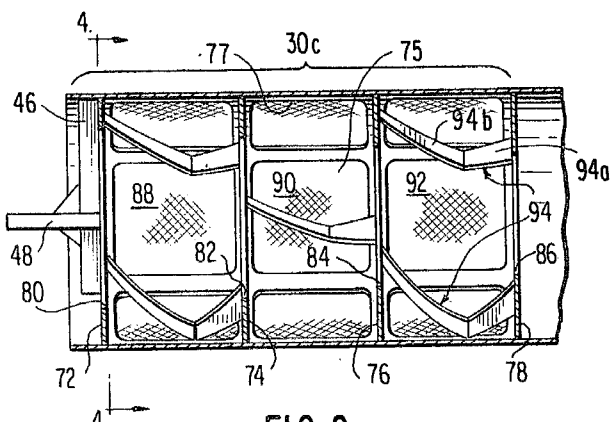
FIG. 2 is a longitudinal sectional view of the upper portion of the cylindrical drum which forms a principal component of the apparatus of FIG. 1.

Both ends of drum 30 are open, as is more easily seen by reference to FIGS. 2 and 3. In that regard, as seen in FIG. 2, the upper screen portion 30*a* of drum 30 is achieved by forming circumferentially spaced openings 65 within drum 30, covered by screening 67. Two annular baffle plates 68 and 69 having relatively large diameter openings form an upstream compartment 70 housing the screened openings, within which the higher specific gravity material passes on its way out of the upper open end of the drum 30 formed by a circular opening 69*a* within the baffle plate 69.

Internally within drum 30, there are mounted to the inner surface thereof, a plurality of helical strips as at 71 which extend from a dewatering section 30*c* through the complete length of a central agitation section 30*b* to the upper screen section 30*a* of drum 30. The helical strips 71 function to drive the heavier, i.e., higher specific gravity materials towards the open front end of drum 30 when the drum is rotated about its axis in the direction of the helical strips 71, FIG. 3. The helical strips 71 may comprise three sets which are circumferentially located 120° from each other and which are of a height such that their radially inner edges are spaced a few inches from the inner surface or inner periphery of the drum. With the helical strips 30 of very short height, these members do not contact the lighter weight particles of lesser specific gravity, i.e., the coal particles which tend to float on the water accumulating within the drum. The helical strips 71 extend the complete length of an intermediate agitation section 30*b* of the drum 30.

Referring next to FIG. 2, a very important aspect of the present invention resides in the make up of the third portion or dewatering section 30*c* of the drum 30, at its lower, discharge end and at the rear of the chassis 12. The drum 30 bears, at section 30*c*, a plurality of baffle plates indicated from left to right at 72, 74, 76 and 78, the baffle plates being annular in form, having an outer diameter on the order of the inner diameter of drum 30 to which they are affixed by welding or the like. The drum 30 and these baffle plates are formed of metal, as are the helical strips 71. The baffle plates are annular in form, that is, they all have circular openings within the center of the same. In that respect, the discharge end baffle plate 72 is provided with an opening as at 80 which is of relatively large diameter compared with the openings within baffle plates 74, 76 and 78. Baffle plates 72 and 74 form compartment or chamber 88, baffle plates 74 and 76 form compartment or chamber 90 and baffle plates 76 and 78 form compartment or chamber 92 for dewatering section 30*c*. As a matter of fact, the openings from the rear towards the front of this dewatering section 30*b* of the drum 30 are of decreasing size, that is, baffle plate 74 includes an opening 82 of a diameter less than that of opening 80. The second or intermediate baffle plate 76 is provided with an axial opening 84 of even smaller size, while upstream baffle plate 78 is provided with the smallest size circular opening at its center, as at 86. With at least upstream baffle plate 78 being sealed at its outer periphery to the interior of the drum 30, the upstream baffle plate 78 functions as a downstream barrier for the water entering drum 30 upstream of drum dewatering section 30*c*. The diameter of the opening 86 within baffle plate 78 determines the height of accumulated water W within the drum 30, to level L, FIG. 1. The lighter specific gravity material, i.e., the coal particles, tend to float to the top of the water in the drum 30 during its rotation, with the helical strips 71 functioning to agitate the water and to effect the desired separation of the lighter fractions or coal from the heavier fractions or waste which then is driven by the helical strips 71 towards the front of the drum 30.

Each of the chambers 88, 90 and 92 are provided with a plurality of flanged diverter elements or plates as indicated generally at 94, these elements are essentially L-shaped in configuration including an upstream base portion 94*a* and a downstream leg portion 94*b*. Each leg portion 94*b*, which is somewhat shorter in length than the base portion 94*a*, is rigidly attached, such as being welded to the transverse baffle plate at the upstream end of the chamber within which the flanged diverter element 94 is placed, the element 94 extending adjacent the inner periphery of the drum, while the end of the leg portion 94*b* remote from its engagement with the base portion 94*a* is welded to the downstream transverse baffle plate. Further, it is desired that, preferably the radial height of the leg portion 94*b* at the point where it makes contact with and is affixed to the downstream baffle plate for a given chamber be slightly higher than the annular wall formed by that baffle plate, that is, project above the opening so as to divert the coal from an upstream dewatering chamber to the adjacent downstream chamber.

In that respect, therefore, for chamber 92, it may be seen that for each element 94, the base portion 94*a* is attached, by welding or the like at its upstream end, to the inner surface of the downstream surface of baffle plate 78, while at the opposite end of the diverter element 94, the end of the leg portion 94*b* is welded to the upstream face of the baffle plate 76.

This is also true for chambers 88 and 90 and for the baffle plates within those chambers or compartments.

Figure 4:
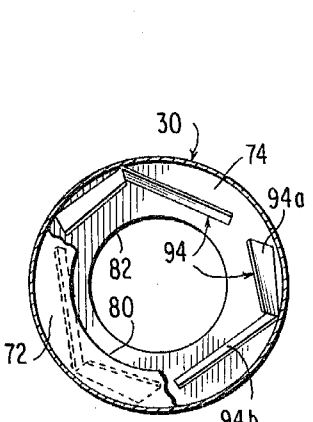
FIG. 4 is a transverse sectional view of a portion of the cylindrical drum illustrated in FIG. 3, taken about line 4—4.

Reference to FIG. 4 shows the downstream baffle plate 72 partially broken away so that two of the three flanged diverter elements 94 may be seen including the upstream base portions 94*a* and the downstream leg portion 94*b* for those members. As may be further appreciated, the opening 82 within the baffle plate 74 is seen as being smaller than opening 80 for the downstream or end baffle plate 72 at the exit end of the drum.

As may be further appreciated by reference to FIG. 1, the present invention advantageously employs a V-shaped, open top, waste trough indicated generally at 96 which forms a further important aspect of the present invention and which underlies the main frame or chassis 12 and is fixed thereto. The waste trough 96 is defined by two oppositely inclined walls 98 forming a V-shaped structure supported by and fixed to the bottom of the main frame or chassis 12 by suspension rods or posts 100 which are mounted to the walls 98 at their upper edges, along both sides and at longitudinally spaced positions. Further, the trough 96 includes an inclined trough section 96*a* at its forward end leading upwardly to the level of the main frame or chassis 12 at which point the waste material can discharge at the front of the trailered apparatus.

Mounted within the bottom of trough 96 is an auger indicated generally at 102 of conventional form, extending longitudinally the length of the trough 96 and being rotatably supported by bearings, as at 104, for rotation about its axis. An auger drive motor is indicated generally at 106, mounted to the rear of the trough 96 and which may be either a hydraulic motor or an electric motor, as desired. The function of the motor 106 is to drive the auger 102 in a direction tending to drive waste material falling into the chute 96, forwardly in the direction of the trailer front end.

To facilitate the movement of water and fine waste into the trough 96, the main frame or chassis 12, at its rear, bears a number of trough extension plates. One, at 108, lies to the rear of the trough 96, and others at 110, to each side thereof. They underlie the wire mesh screen dewatering section 30*c* of the cylindrical drum 30 such that some of the fine waste material and water which by gravity falls downwardly from the drum during its rotation, as indicated by arrows 112, contacts the inclined trough extension plates 108, 110 and moves into the upwardly open V-shaped trough 96 into contact with the auger 102 to be driven forwardly, towards the front of the trough 96 and upwardly within the trough extension portion 96*a*.

In addition to the fine waste and water bearing chute 96, the apparatus is provided with a large waste particle chute 114 at the front of the machine, being supported by posts as at 118 on chassis 12 and being inclined upwardly, from front to rear, such that its upper end opens to the open frontal end of the cylindrical drum 30, whereby during operation, the higher specific gravity material discharges from that end of the drum during rotation of the drum 30 about its axis driven by drum drive motor 58, while fine waste and some water passes outwardly of the screened openings 70, as indicated by arrows 120.

Advantageously, in operation, the water admitted to the trough or chute 62 bearing the unwashed coal from hopper 60 causes this unwashed coal to flow into the upper end of the cylindrical drum 30. After the material is in the cylindrical drum 30 and within waste W, it is agitated by the rotation of the cylinder and the helical strips 71 contacting the same. The water level is maintained in the manner shown in FIG. 1 such that the water reaches the mesh screen 67 at the frontal openings 65 within the cylindrical drum section 30*a*. The water, which is forced into the helical strips 71, causes the material with the lower specific gravity (coal) to float thereon and move towards the lower end of the cylindrical drum 30 for discharge out the circular discharge opening 80 within the downstream baffle plate 72 of dewatering section 30*c*. The material with the higher specific gravity, i.e., heavier waste material, is conveyed to the higher, front end of the cylindrical drum 30 by the helical strips 71 as the cylindrical drum 30 rotates in the twist direction of these helical strips. This higher specific gravity material is discharged onto the waste conductor or chute 114.

The variation in the specific gravity content of the material discharged at the front end and at the rear of the machine is determined by the angular inclination or elevation of the front end of the cylindrical drum 30 relative to its rear, the velocity of rotation of the drum 30 about its axis, and the volume of the water accumulating within the bottom of the drum 30 as controlled by the size of opening 86 within the upstream baffle plate 78 of the dewatering section 30*c* of the drum, and the velocity of water being introduced into the cylindrical drum 30. After the material of lower specific gravity passes into the dewatering section 30*c* over the circular edge of upstream baffle plate 78 at opening 86, dewatering of the coal results since any water carried by the material is lost by gravity through the wire screen 75 overlying opening 77 formed within the walls of the cylindrical drum 30 forming chambers 92, 90 and 88, and as the material is transferred to the dewatering compartments or chambers in a sequence from chamber 92 to chamber 90 and thence to chamber 88 by the flanged diverters or diverter elements 94. Much of the remaining fine waste is separated from the coal and the coal is thoroughly washed. Clean washed coal is discharged at the rear end of the cylindrical drum 30 through opening 80 of the downstream baffle plate 72.

As may be appreciated, most of the coal washing equipment presently in use in the coal fields washes coal by means and by use of chemicals or other substances of heavy media. However, there are no effective dual washing and separating machines which utilize water and water pressure to separate slag from coal as is achieved in a compact and efficient manner by the portable apparatus of the present invention.

Further, while the drum 30 is preferably driven by a drum drive motor through a rubber drive wheel in peripheral contact and under frictional drive principles, this can be modified to suit demands. While the method of adjusting the incline of the drum by the use of one fixed pivot axis pin as at 22, at the forward end of the cradle and by the use of a height adjustable rod 28 passing through aligned holes within vertical posts 24, at the rear of the trailer, operates adequately to achieve this desired end, these means may be eliminated and other mechanisms employed to accomplish that purpose. Additionally, while the auger is shown as being driven by a motor 106 at the rear of the trough 96, it could be driven by the same drive motor 54 functioning to rotate the drum 30, or by a separate motor at a different location.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An improved vehicle trailer mounted apparatus for separating coal from material of higher specific gravity, said apparatus comprising:

an open ended, elongated cylindrical drum, means for mounting said drum for rotation about its axis and inclined slightly from the horizontal with its rear end lower than its front end, helical strips mounted to the inner wall of said drum and extending radially upwardly therefrom, an inclined coal delivery chute opening into the upper end of said drum for supplying unwashed coal to said drum, means for flushing said chute with water for driving unwashed coal on said chute into said drum, means for maintaining a layer of water within the bottom of said drum such that the lighter specific gravity coal material floats with the water towards the lower, rear end of said drum, and means for rotating said drum about its axis to agitate the materials within the accumulated water and to drive the higher specific gravity material captured by said helical strips towards the upper, open end of said drum, the improvement comprising:

screened openings within said drum adjacent to its lower end and separated by a plurality of longitudinally spaced annular baffle walls bearing central openings and forming longitudinally adjacent compartments and, angled diverter strips carried by said drum along the inner wall thereof overlying the screened openings and extending within compartments defined by said longitudinally spaced annular baffle walls and acting to lift coal over the longitudinally spaced baffle walls and through the baffle wall central openings to permit axial drum discharge of the washed and separated coal while permittng water and waste fines to fall by gravity through the screened openings at the lower end of said drum.

2. The apparatus as claimed in claim 1, further comprising screened openings carried at the upper end of said drum, upstream of the point where the coal delivery chute enters said drum interior such that during rotation of said drum and helical strip driving of the higher specific gravity waste material upwardly towards the open upper end of said drum, water and waste fines may fall through said screened openings while the larger particles of the higher specific gravity waste material discharge through the open upper end of said drum, separated from said fine waste material.

3. The apparatus as claimed in claim 1, further comprising an upwardly open waste trough underlying said rotating drum and extending the full length of said rotating drum from one screened end to the other, said waste trough bearing a rotating auger within the bottom thereof for rotation about its axis, and means for rotating said auger such that water and fine waste entering said waste trough from said screened openings within the drum lower end are driven towards the front of said apparatus for discharge in the vicinity of the higher specific gravity waste material discharging from the front end of said open drum.

4. The apparatus as claimed in claim 2, further comprising a waste trough underlying said rotating drum and extending the full length of said rotating drum from one screened end to the other, said waste trough being open at its top, and bearing a rotating auger within the bottom thereof for rotation about its axis, and means for rotating said auger such that water and fine waste entering said waste trough from said screened openings within the drum lower end are driven towards the front of said apparatus for discharge in the vicinity of the higher specific gravity waste material discharging from the front end of said open drum.

5. The apparatus as claimed in claim 3, wherein said annular baffle plates comprise at least three in number, are mounted within said drum at right angles to the axis of the drum and are provided with circular openings of decreasing diameter from the upstream baffle plate towards the downstream baffle plate such that said upstream baffle plate defines the water level within the inclined rotating drum from said upstream baffle plate to said upstream screened area of said drum at the upper end thereof.

6. The apparatus as claimed in claim 5, wherein said diverter plates comprise L-shaped elements mounted to the interior of said drum including a base portion fixed at one end to an upstream baffle plate and a leg portion extending generally at right angles thereto and being fixed at its end remote from said base portion to a downstream baffle plate, and wherein said leg portion is fixedly attached to the downstream baffle plate such that the radially inner edge of said leg portion extends above the circular opening within the downstream baffle plate to insure the movement of coal through the compartment defined by the upstream and downstream baffle plates bearing said diverter plates and into the succeeding downstream compartment.

7. The apparatus as claimed in claim 1, wherein said drum is mounted for rotation on an angularly adjustable inclined cradle borne by a horizontally extending trailer chassis, and wherein means are provided for mounting said cradle for rotation about a fixed horizontal pivot axis adjacent its forward end and means for adjustably fixing the vertical height of the rear end of said cradle, said vertical height adjusting fixing means comprising posts fixedly mounted to said chassis and rising vertically therefrom, holes within said posts, and a horizontal rod projecting through aligned holes on said posts to opposite sides of said rotating drum and said cradle and underlying said cradle for maintaining said cradle near its rear end at a vertically adjustable height above said chassis.

* * * * *